United States Patent [19]

Forny et al.

[11] 4,315,574

[45] Feb. 16, 1982

[54] CONTAINER HAVING CIRCUMFERENTIAL AND LONGITUDINAL STIFFENING CORRUGATIONS

[75] Inventors: Arnold Forny, Gwatt; Jakob Koch, Hünibach; Hans Niederer, Oberwichtrach; Otto Schmid, Hünibach, all of Switzerland

[73] Assignee: Gebr. Hoffmann AG, Switzerland

[21] Appl. No.: 115,891

[22] Filed: Jan. 28, 1980

[30] Foreign Application Priority Data

Feb. 1, 1979 [CH] Switzerland ..... 994/79

[51] Int. Cl.[3] ..... B65D 8/12

[52] U.S. Cl. ..... 220/72

[58] Field of Search ..... 220/72; 113/120 W

[56] References Cited

U.S. PATENT DOCUMENTS

| | | | |
|---|---|---|---|
| 2,629,534 | 2/1953 | Reynolds | 220/72 X |
| 2,656,066 | 10/1953 | Riemenschneider | 220/72 X |
| 3,335,902 | 8/1967 | Javorik | 220/72 |
| 3,472,418 | 10/1969 | Ullman | 220/72 |
| 3,536,500 | 10/1970 | Cleereman et al. | 215/1 C X |

FOREIGN PATENT DOCUMENTS

| | | | |
|---|---|---|---|
| 42279 | 6/1933 | France | 220/72 |
| 264732 | 1/1927 | United Kingdom . | |
| 754549 | 8/1956 | United Kingdom . | |
| 972165 | 10/1964 | United Kingdom . | |
| 1304539 | 1/1973 | United Kingdom . | |
| 1375070 | 11/1974 | United Kingdom . | |

*Primary Examiner*—Allan N. Shoap
*Attorney, Agent, or Firm*—McGlew and Tuttle

[57] ABSTRACT

An improved container in form of a barrel, drum can or the like, specifically a sheet metal container. The circumferential wall of the container is provided with horizontally extending corrugations or beads, respectively, and vertically extending corrugations. The vertically extending corrugations are ordered in groupwise spaced arrangements. Such container has improved loading characteristics in the axial and circumferential direction thereof and has an improved impact resistance.

13 Claims, 10 Drawing Figures

CONTAINER HAVING CIRCUMFERENTIAL AND LONGITUDINAL STIFFENING CORRUGATIONS

BACKGROUND OF THE INVENTION

1. Field of the Invention

The present invention relates to a container or the like, which container is provided with a body having stiffening corrugations or beads, respectively, formed therein.

2. Description of the Prior Art

Containers are commonly provided with a body, a bottom and a cover. The bottom and the cover of such containers have various design and structure, are fixedly or releasably mounted to the body of the container, and may or may not be provided with a discharge opening such to meet prevailing requirements.

The load resistance, specifically the circumferential load resistance and the axial load resistance as well as the impact resistance, the latter being determined by dropping tests or radially directed impact tests, are mainly determined by the shape of the container body, i.e. the side walls thereof. It is desirable to manufacture containers which have a high axial load resistance and a high impact resistance and which are specifically stable under internal vacuum conditions.

Known containers are respectively provided with sheet metal or metal plate bodies. During manufacture, such bodies are initially formed by soldering or welding cylindrical sheet metal plates. Thereafter, the final shape is formed by means of shaping tools. The prior art is also cognizant of impressing aligned corrugations or beads, respectively, during the shaping of the body, which corrugations extend either vertically and/or horizontally and/or spirally in the circumferential surface of the body. Furthermore, the application of arbor supports for an improved impressing of the corrugations is also known.

However, the improvement of the load resistance of containers manufactured in accordance with the above outlined procedures is rather limited.

In the Belgian Pat. No. 411,724 horizontally extending corrugations are given priority. Because the vertically extending corrugations have a smaller depth than the horizontally extending corrugations, the effect thereof, relating to the axial load resistance, is eliminated at the intersections between the horizontal and the vertical corrugations, and, if subject to an axially directed load, the container is prone to fold or cave in at this area. Furthermore, the shape, i.e. the depth of the horizontally extending corrugations is strongly pronounced. Such shape is extremely disadvantageous regarding the axial pressure load resistance.

The same proves true for the containers disclosed in the U.S. Pat. Nos. 3,357,593 and 3,335,902, according to which nodal areas are formed at the intersections, thus reducing the axial pressure load resistance. In the mentioned areas the vertically extending corrugations are reduced to a line.

SUMMARY OF THE INVENTION

Hence, it is a general object of the present invention to provide an improved container having a higher load resistance and which, at the same time is simpler to manufacture.

A further object is to provide an improved container which allows the use of a thinner material for forming the body yet without suffering a reduction of its load resistance.

Yet a further object of the invention is to provide an improved method of manufacturing a container allowing the use of a thinner raw material yet achieving a higher load resistance.

Now, in order to implement these and still further objects of the invention, which will become more readily apparent as the description proceeds, the improved container of this development is manifested by the features that the body is provided with corrugations or beads, respectively, or groups of corrugations or beads, respectively, consisting of individual vertically extending corrugations arranged side by side and staggered vertically relative to each other, which corrugations extend at least over the larger part of the height of the body, which vertically extending corrugations or individual corrugations intersect the area of the circumferential corrugations or the circumferential corrugations without disrupting same.

According to the invention, the vertically extending corrugations are given priority over the circumferentially extending corrugations. It has been recognized that a disruption of the circumferentially extending corrugations by vertically extending corrugations has practically no detrimental effect regarding the radial load resistance of the container, whereby however a disruption of the vertically extending corrugations produces an extremely harmful effect on the axial load resistance. According to a preferred embodiment the impressed depth of the vertically extending corrugations is larger than such of the relatively shallow horizontally extending corrugations.

Preferably, the vertically extending corrugations are arranged in groups which in turn are arranged circumferentially at a distance from each other. In case of a noncircular cross-sectional shape of the body, the mentioned groups are preferably foreseen in the corner areas thereof.

The invention ignores the fears of the prior art, according to which the superimposing of parallel extending corrugations with differently extending corrugations shall abolish at least partly the stiffening effect of the former corrugations and cause furthermore an unacceptable stressing or weakening of the material of the body. Surprisingly, the contrary has been proven, namely that the corrugations which are vertically superimposed over the horizontally extending corrugations lead not only to an improved axial load resistance of the body in a vertical, i.e. axial direction but also do not reduce the strength in circumferential direction and can rather possibly increase such strength if the vertically extending corrugations are arranged specifically skillfully such as e.g. in groups of which each vertical row of corrugations comprises individual corrugations arranged at a vertical distance from each other, whereby the individual corrugations of adjoining rows can be arranged staggered relative to each other.

An arrangement which has been proven as especially useful is such including two outer rows of corrugations having individual corrugations arranged at the same height and a center row of corrugations having thereto vertically staggered individual corrugations.

An especially surprising result is that an arrangement of such groups with vertically extending corrugations has proven to be advantageous if arranged at the corner areas of the cross section of the body. Commonly such bodies have been formed by an expansion shaping followed by the impressing of the corrugations. Accordingly, the person skilled in the art had to expect a specifically high load concentration in the material of the body.

The considerable increase of the load resistance of the container and specifically of the axial load resistance thereof allows a smaller wall thickness of the body material.

A further object of the invention is to provide a simpler manufacture of a container. An inventive method is manifested by the steps of expanding the body from within by an application of a deforming force and by an application of an outer counter holding and by a shaping into the desired form and impressing in the body circumference at least approximately in themselves closed horizontally or slightly inclined extending corrugations as well as vertically extending corrugations, whereby at least the horizontally and slightly inclined corrugations are impressed whilst maintaining the counter holding force and the shaping force.

In case of containers made of a plastics material obviously a thermoplastic shaping method can be applied.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
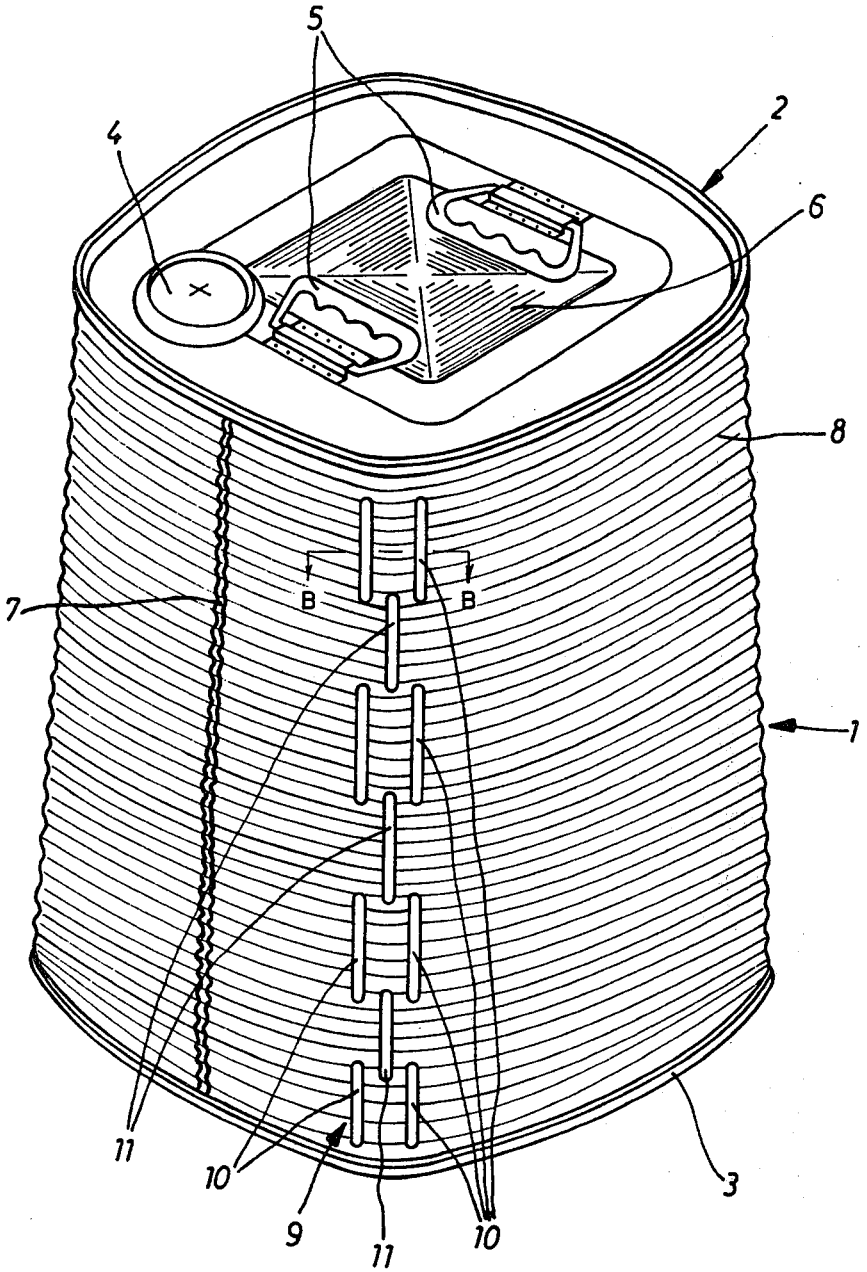
FIG. 1 is a perspective view of an embodiment of the inventive container.

Describing now the drawings and considering initially the exemplary embodiment of the container in FIG. 1, it will be understood that same comprises a sheet metal body 1. A cover 2 and a bottom 3 are connected to the body means of jointed flange connections. The material used may be tin plate, black iron sheet, chrome-plated sheet metal, aluminium, nonferrous metal and the like.

It is also foreseeable to fabricate the container by a plastics-foil material.

The body 1 which as shown can taper against its top end is joined along a vertically extending seam 7 and comprises circumferentially extending horizontal first corrugations or beads 8 and comprises further at its four corner areas a group 9 of vertically extending second corrugations or beads each extending approximately or preferably along the entire height of the body 1. Every group of vertically extending corrugations comprises three rows of individual corrugations 10, 11, whereby the individual corrugations 10 of the outer rows are arranged at the same level and the individual corrugations 11 of the center row are arranged staggered thereto and thus overlap the individual corrugations 10 of the outer rows.

Figure 2:
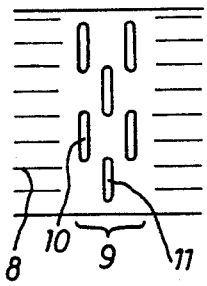
FIGS. 2 to 4 show schematic side views of alternate embodiments of the body.
Figure 3:
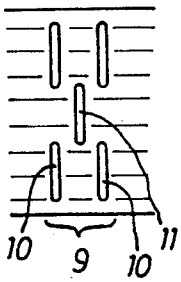

FIGS. 2 to 6 disclose various configurations of the arrangement of the corrugations whereby the arrangement of FIG. 3 corresponds to the arrangement shown in FIG. 1.

For sake of ease the various parts of the embodiments described below are provided with the same reference numerals as used above.

The embodiment of FIG. 2 differs from such of FIG. 3 in that the horizontally extending corrugations 8 are interrupted in the general area of the group 9 occupying the vertical corrugations 10, 11, whilst according to the embodiment of FIGS. 1 and 3 the horizontally extending corrugations 8 penetrate into the general area of the vertical corrugations 10, 11 that is, extend between the individual vertical corrugations of the group.

Figure 4:
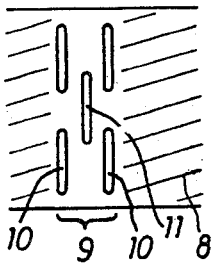
Figure 5:
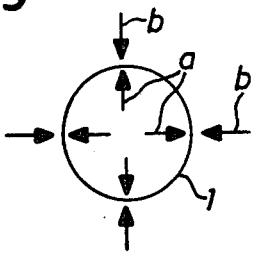
FIGS. 5 and 6 schematical top views of steps of manufacture of an inventive container.

The embodiment of FIG. 4 comprises an arrangement of the corrugations 10, 11 which is basically similar to the embodiment of FIG. 2. The difference is here that the horizontal corrugations 8 extend slightly slanted or inclined, respectively, to the true horizontal direction. In order to maintain a sufficient stability the largest inclination retlative to the circumferential direction or radial direction, respectively, should amount to not more than 15°.

A practical embodiment made in accordance with FIG. 1, however, for a container with a circular cross section, has the following measurements:

Height of body: 380 mm (1 ft. 3 in.)
Diameter of body: 320 mm (1 ft. 19/32 in.)
Volume: 25 liters (6.6 US gals.)
Thickness of sheet metal: 0.25 mm (1/100 in.)
Axial loading capability: ca. 1000 kp (2200 lbs.)

In comparison with a prior art container having comparable dimensions the axial loading capability could be increased by about 400 kp (880 lbs.).

The steps of manufacturing a container shown in the above described figures are in the following explained with reference to FIGS. 5 to 9.

During a first stretching operation a sheet or foil material is expanded cylindrically by application of a shaping force (arrows a) and of outer counter holdings (arrows b). If the body 1 is to remain round or oval, the horizontally or slightly inclined, respectively, and the vertical corrugations 10, 11 are impressed simultaneously.

Figure 6:
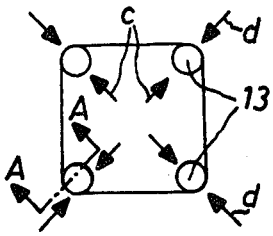

Should the final shape of the body feature a cornered cross section a further stretching operation in the direction of the arrows c is carried out such as shown in FIG. 6 by utilization of bar-like stretching tools 13 whereby also a counter holding in the direction of the arrows d acting from the outside is maintained. Following, the shaping force is reduced somewhat such that the body material is relieved partly, however not completely, from the tension loading applied in circumferential direction by the stretching bars. In this condition, whereby the body is still subject to a residual stretching tension the vertical corrugations are impressed.

Figure 7:
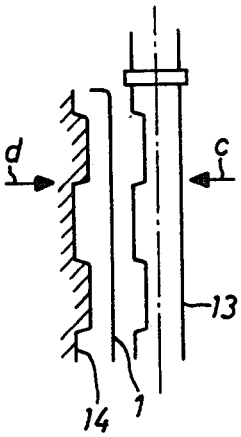
FIGS. 7 to 9 vertical partial sections along the line A—A of FIG. 6, whereby for sake of clearness the parts of the tools taking part in the manufacture of the body to be shaped are shown retracted from the body.
Figure 9:
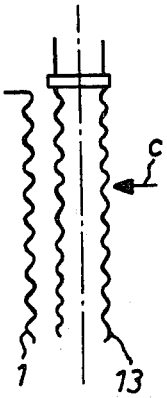
Figure 10:
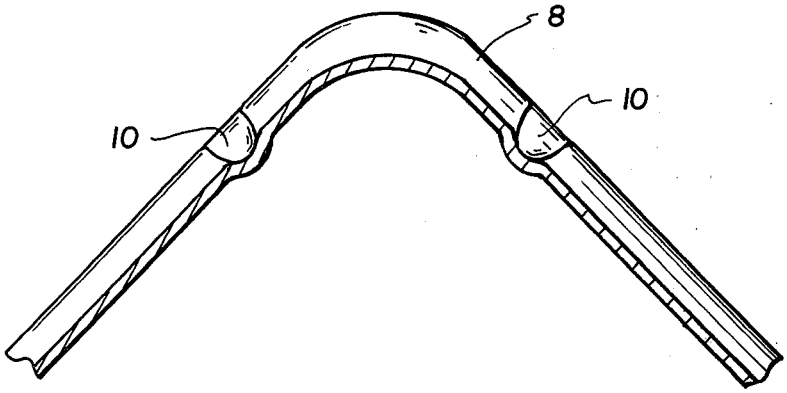
FIG. 10 is a sectional view taken along line B—B of FIG. 1.

It is of importance that the horizontal or inclined, respectively, corrugations which were impressed in the circular form condition of the body are maintained during the further stretching operation in accordance with FIG. 6 and that during this further stretching operation the vertical corrugations can be impressed. FIGS. 7 and 9 show schematically the thereto necessary profiles of the stretching bars 13 and counter holers 14, respectively.

Figure 8:
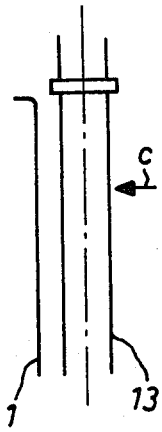

In FIG. 7 there is shown the profile applied for the vertical corrugations. In FIGS. 8 and 9 there are shown possible profiles applied for the horizontal or inclined corrugations which in accordance with the impressed form sought for latter corrugations are superimposed over the stretching bar 13 or counter holder 14, respectively, or both in accordance with FIG. 7.

For shaping the forms of the corrugations shown in FIGS. 2 and 4 the stretching bars are profiled relative to the vertical corrugations such as shown in FIG. 7, whereby the stretching bars are additionally profiled relative to the horizontal or inclined corrugations in order to achieve the shapes of the corrugations in accordance with FIGS. 2 and 4 as shown in FIG. 8 and for the shapes in accordance with FIG. 3 as shown in FIG. 9.

During manufacture, the inventive combinations of corrugations can be realized with known machines and acceptable expenses regarding tools and with relative small forming forces which are lower than those needed for impressing the corrugations into sheet metals used for the bodies which are still in their flat condition.

The manufacturing can proceed automatically and in series whereby also thin sheets with relatively high rigidity can be processed. The increase in strength and rigidity thereby achieved by the cold shaping can be utilized to the desired extent.

The invention may be used for any size of containers, such as e.g. cans, tins or petrol cans or tins, large containers, barrels, drums, etc. Obviously the shaping in accordance with the invention can proceed from the inside towards the outside or from the outside towards the inside or both.

The inventive shaping of the container material can be made prior to, during or after the manufacture of the container and by means of various shaping methods.

The embodiment shown in FIG. 2 is specifically advantageous for cornered containers having rounded corners and the embodiment shown in FIG. 3 is specifically advantageous for the fabrication of circular containers.

The vertical corrugations 10, 11 are provided specifically in an embodiment of FIGS. 1 and 3, of which the horizontal corrugations 8 penetrate the general area of the vertical corrugations 10, 11 and have a deeper profile than the horizontal corrugations. Every individual vertical corrugation is uninterrupted along its complete extent including the areas of intersecting the horizontal corrugations and, therefore, is not weakened. Furthermore, the profile of the vertical corrugations 10, 11 remains unaltered at the intersections and are thereby at least substantially and preferably completely preserved.

The relatively flat or shallow, respectively, circumferential corrugations 8 surround preferably the circumference of the container in a tin themselves closed form. In the embodiment in accordance with FIGS. 1 and 3 they are interrupted only at the intersections with the vertical corrugations to an extent of the width of the vertical corrugations.

Usually the impressing of the corrugations is carried out in two steps. A first step involves an expanding of the body of the container from the inside, whereby a shaping force is applied and an outer counter holding maintained, whereby the body is brought into its desired shape and whereby the circumferential corrugations 8 are impressed simultaneously. Thereafter, during a second step the vertical corrugations 10, 11 are impressed either from the inside or from the outside while maintaining again a counter holding at the outside or inside, respectively. Prior to impressing the vertical corrugations the shaping force is relieved either completely or partially.

However, the circumferential corrugations 8 and the vertical corrugations 10, 11 can be embossed simultaneously in one step from the inside by maintaining mentioned shaping force and counter holding.

It is also possible to arrange the vertical corrugations of one group in more than three adjoining rows.

The groups of vertical corrugations 10, 11 could also be arranged closely following one another in circumferential direction such that no pronounced distance prevails between any group.

While there are shown and described preferred embodiments of the invention, it is to be distinctly understood that the invention is not limited thereto, but may be otherwise variously embodied and practiced within the scope of the following claims.

What is claimed is:

1. An improved container of a thin-walled material of the type having an elongated body with a longitudinal axis and a circumferentially extending wall, the body having first stiffening corrugations extending in its circumferential direction and second stiffening corrugations extending at least approximately in its longitudinal direction, the improvement comprising the first stiffening corrugations having circumferential discontinuities, said discontinuities arranged to define a longitudinal path the second stiffening corrugations longitudinally extending in said path in side by side groups staggered relative to each other in the longitudinal direction, and the second stiffening corrugations extending at spaced intervals at least along a larger part of the height of the body.

2. The improved container of claim 1, wherein said groups of the second stiffening corrugations are arranged circumferentially spaced from one another.

3. The improved container of claim 1, wherein the body has a non-circular body cross section, and one of the groups of the second stiffening corrugations is arranged at every corner area.

4. The improved container of claim 2, or claim 3, wherein each said group of the second stiffening corrugations comprises rows of corrugations incorporating individual corrugations arranged at a longitudinal distance from each other and wherein the individual corrugations of adjoining rows are staggered relative to one another.

5. The improved container of claim 4, wherein each of the second stiffening corrugations of said adjoining rows of the second stiffening corrugations are arranged longitudinally staggered relative to each other.

6. The improved container of claim 4, wherein the first stiffening corrugations extend between the second corrugations.

7. The improved container of claim 6, wherein the first stiffening corrugations have ends staggered relative to each other in the circumferential direction adjacent each side of the second stiffening corrugations.

8. The improved container of claim 1, wherein each of the second stiffening corrugations of adjoining rows of the second stiffening corrugations are arranged longitudinally staggered relative to each other.

9. The improved container of claim 1, wherein the first stiffening corrugations are distributed across the length of the body and extend across the entire circumference of the body.

10. The improved container of claim 1, wherein the first stiffening corrugations extend between the second stiffening corrugations.

11. The improved container of claim 10, wherein the first stiffening corrugations have ends staggered relative to each other in the circumferential direction adjacent each side of the second stiffening corrugations.

12. The improved container of claim 1, wherein the first stiffening corrugations have ends staggered relative to each other in the circumferential direction adjacent each side of the second stiffening corrugations.

13. The container of claim 1, wherein the second stiffening corrugations have a profile with a greater depth than the profile of the first stiffening corrugations.

* * * * *